US007382988B2

(12) United States Patent
Nakazato

(10) Patent No.: US 7,382,988 B2
(45) Date of Patent: Jun. 3, 2008

(54) IMAGE FORMING APPARATUS

(75) Inventor: Yasushi Nakazato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 10/972,384

(22) Filed: Oct. 26, 2004

(65) Prior Publication Data

US 2005/0111858 A1 May 26, 2005

(30) Foreign Application Priority Data

Oct. 27, 2003 (JP) ..... 2003-366070

(51) Int. Cl.
*G03G 15/01* (2006.01)
*G03G 21/18* (2006.01)

(52) U.S. Cl. ..... 399/12; 399/112

(58) Field of Classification Search ..... 399/12, 399/112, 9, 110, 111; 347/138, 152
See application file for complete search history.

(56) References Cited

U.S. PATENT DOCUMENTS

| | | | | |
|---|---|---|---|---|
| 5,014,094 | A * | 5/1991 | Amitani et al. | 399/12 |
| 5,464,200 | A | 11/1995 | Nakazato et al. | 270/53 |
| 5,482,265 | A | 1/1996 | Nakazato et al. | 271/242 |
| 5,606,408 | A | 2/1997 | Yano et al. | 399/343 |
| 5,638,159 | A | 6/1997 | Kai et al. | 399/253 |
| 5,715,500 | A | 2/1998 | Nakazato et al. | 399/124 |
| 5,740,494 | A | 4/1998 | Shoji et al. | 399/71 |
| 5,765,087 | A | 6/1998 | Yano et al. | 399/344 |
| 6,023,594 | A * | 2/2000 | Okiyama et al. | 399/12 |
| 6,034,792 | A | 3/2000 | Nakazato et al. | 358/497 |
| 6,236,820 | B1 | 5/2001 | Nakazato et al. | 399/111 |
| 6,295,435 | B1 | 9/2001 | Shinohara et al. | 399/301 |
| 6,345,170 | B1 | 2/2002 | Nakazato et al. | 399/388 |
| 6,381,435 | B2 | 4/2002 | Shinohara et al. | 399/301 |
| 6,400,917 | B2 | 6/2002 | Nakazato et al. | 399/111 |
| 6,466,754 | B2 | 10/2002 | Nakazato et al. | 399/111 |
| 6,470,169 | B2 | 10/2002 | Nakazato | 399/388 |
| 6,580,887 | B2 | 6/2003 | Nakazato et al. | 399/111 |
| 6,669,189 | B2 | 12/2003 | Seto et al. | 271/186 |
| 6,681,096 | B2 | 1/2004 | Seto et al. | 399/102 |
| 6,697,588 | B2 | 2/2004 | Nakazato et al. | 399/111 |
| 6,721,523 | B2 | 4/2004 | Sugiura et al. | 399/176 |
| 6,760,557 | B2 | 7/2004 | Nakazato et al. | 399/111 |
| 6,768,886 | B2 | 7/2004 | Nakazato et al. | 399/111 |
| 6,799,012 | B2 | 9/2004 | Shakuto et al. | 399/357 |
| 2003/0039494 | A1 | 2/2003 | Shakuto et al. | 399/357 |

(Continued)

FOREIGN PATENT DOCUMENTS

| | | | |
|---|---|---|---|
| JP | 2001-201910 A | * | 7/2001 |
| JP | 2002-132011 A | * | 5/2002 |
| JP | 2003-84534 | | 3/2003 |

*Primary Examiner*—Sophia S Chen
(74) *Attorney, Agent, or Firm*—Oblon, Spivak, McClelland, Maier & Neustadt, P.C.

(57) ABSTRACT

A process cartridge of the present invention is removably mounted to the body of an image forming apparatus and includes an image carrier and a developing device configured to develop a latent image formed on the image carrier. A cartridge body, forming major part of the process cartridge, is applicable to a developer of any kind stored in the developing device and is mounted to the apparatus body with an identification member indicative of the kind of the developer fitted thereon. With this configuration, the process cartridge can be surely replaced without any mistake and reduces costs necessary for production, inventory control and delivery.

66 Claims, 11 Drawing Sheets

U.S. PATENT DOCUMENTS

2003/0086722 A1 5/2003 Nakazato et al. ..... 399/93
2004/0013442 A1 1/2004 Suzuki et al. ..... 399/92
2004/0042823 A1 3/2004 Sugiura et al. ..... 399/174
2004/0057059 A1 3/2004 Miura et al. ..... 358/1.7
2004/0076448 A1 4/2004 Nakazato et al. ..... 399/111
2004/0076449 A1 4/2004 Nakazato et al. ..... 399/111
2004/0170446 A1* 9/2004 Nagashima et al. ..... 399/111
2004/0170447 A1* 9/2004 Arai et al. ..... 399/111

* cited by examiner

IMAGE FORMING APPARATUS

BACKGROUND OF THE INVENTION

1. Field of the Invention

The present invention relates to a printer, facsimile apparatus, multifunction machine or similar image forming apparatus. More particularly, the present invention relates to a process cartridge and a device unit removably mounted on an image forming apparatus and a packed kit of the same.

2. Description of the Background Art

It is a common practice with a color copier or similar color image forming apparatus to removably mount a plurality of process cartridges each being assigned to yellow, magenta, cyan or black toner on the apparatus body. The process cartridges each are replaced with new one when, e.g., its mechanical life ends. More specifically, before four new process cartridges are mounted to an image forming apparatus, their developing devices each are filled with a developer containing one of yellow toner, magenta toner, cyan toner and black toner, i.e., either one of a one-ingredient type developer and a two-ingredient type developer. Subsequently, such new process cartridges each are mounted to a particular mount portion included in the new image forming apparatus. Subsequently, when the life of a photoconductive drum or image carrier, developer or similar component of any one of the process cartridge ends due to repeated operation of the apparatus, the user of the apparatus or a service person removes the process cartridge from the apparatus body and then mounts a new process cartridge to the apparatus body.

The prerequisite with the image forming apparatus thus loaded with a plurality of removable process cartridges is that each process cartridge be correctly mounted to preselected one of the mount portions of the apparatus, i.e., a process cartridge assigned to one color be prevented from being mounted to a mount portion assigned to another color. Japanese Patent Laid-Open Publication No. 2003-84543, for example, proposes to provide four process cartridges each having a particular configuration and four mount portions respectively matching in configuration with the process cartridges, thereby obviating erroneous replacement.

However, the problem with the conventional image forming apparatus described above is that the process cartridges need high production cost and moreover need high inventory control cost when stocked. More specifically, the user of the color image forming apparatus of the type described suitably replaces four different kinds of process cartridges that are not replaceable with each other. Therefore, the manufacturer or the distributor of such image forming apparatuses are required to constantly store new process cartridges for replacement as a stock for meeting users' urgent requests. Stocking four different kinds of process cartridges at all times is inefficient from the standpoint of cost and labor for inventory control.

In light of the above, a full-color process cartridge, supporting four different process cartridges assigned to one color each, has been proposed in the past. However, such a process cartridge is naturally bulky and obstructs efficient replacement of the process cartridges while being undesirable from the inventory control standpoint. Further, when the life of one of the four process cartridges ends, even the other process cartridges must be wastefully replaced despite that they are still usable. Moreover, the four process cartridges different in configuration from each other must be produced independently of each other, so that the number of parts and the number of assembling steps increase with the result that the production cost increases.

The problems stated above are not particular to an image forming apparatus of the type using a plurality of process cartridges, but also arise with, e.g., an image forming apparatus in which a plurality of developing units, each including a developing device, are removably mounted to an apparatus body.

SUMMARY OF THE INVENTION

It is an object of the present invention to provide a process cartridge capable of being surely replaced without any mistake and reducing costs necessary for production, inventory control and delivery.

It is another object of the present invention to provide an image forming apparatus using a plurality of process cartridges each having the above advantages.

It is a further object of the present invention to provide a kit in which the major part of a single process cartridge having the above advantages and a plurality of identification members are packed up.

A process cartridge of the present invention is removably mounted to the body of an image forming apparatus and includes an image carrier and a developing device configured to develop a latent image formed on the image carrier. A cartridge body, forming major part of the process cartridge, is applicable to a developer of any kind stored in the developing device and is mounted to the apparatus body with an identification member indicative of the kind of the developer fitted thereon.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
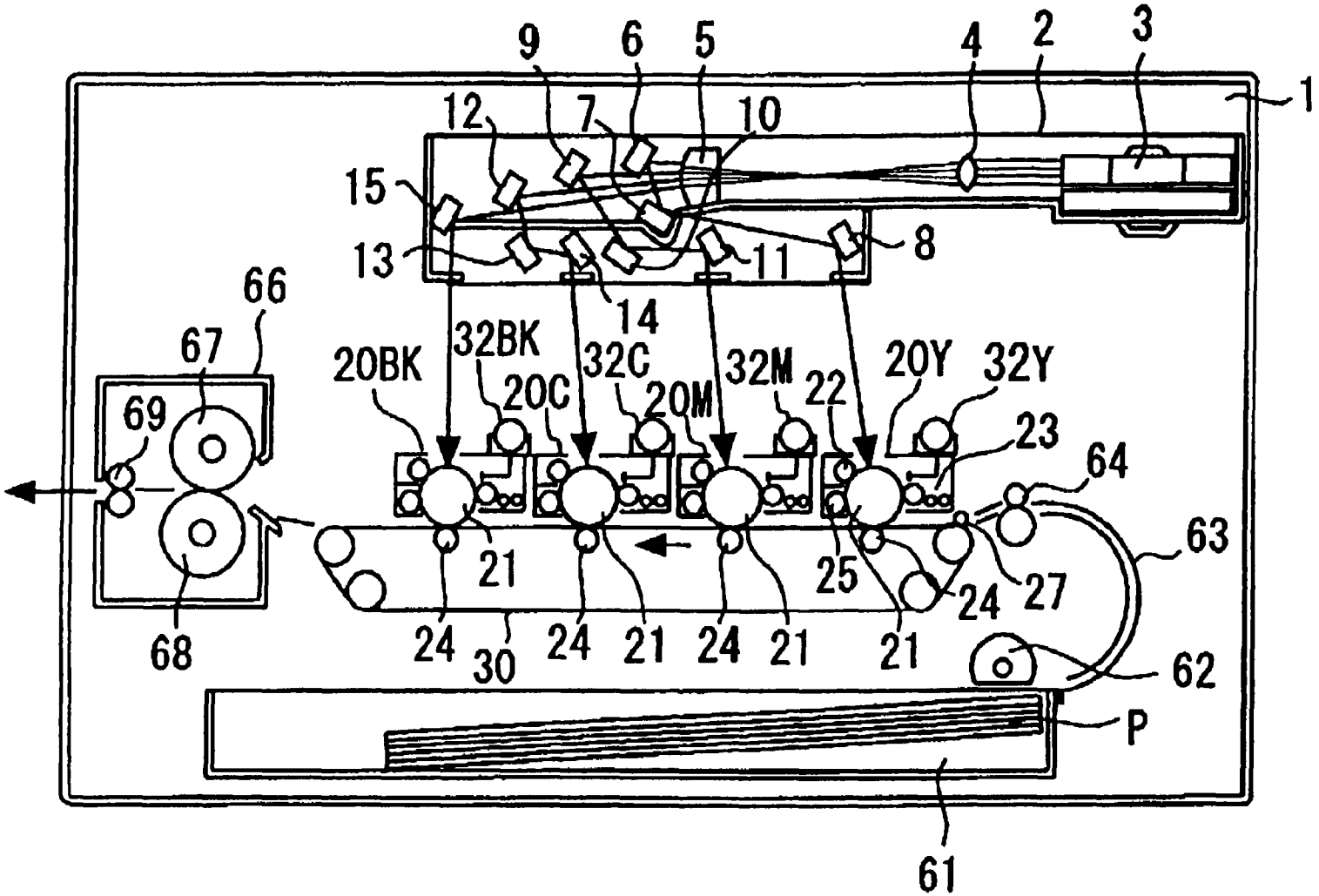
FIG. 1 is a view showing the general construction of a first embodiment of the image forming apparatus in accordance with the present invention.

Preferred embodiments of the image forming apparatus in accordance with the present invention will be described with reference to the accompanying drawings. In the illustrative embodiments, the image forming apparatus is implemented as a color laser printer by way of example. In the drawings, identical structural elements are designated by identical reference numerals and will not be repeatedly described in order to avoid redundancy. It is to be noted that a process cartridge refers to a single unit removably mounted to the body of an image forming apparatus and comprising an image carrier and at least one of a charger or charging means for uniformly charging the image carrier, a developing device or developing means for developing a latent image formed on the image carrier and a cleaning device or cleaning means for cleaning the image carrier.

First Embodiment

Figure 2A:
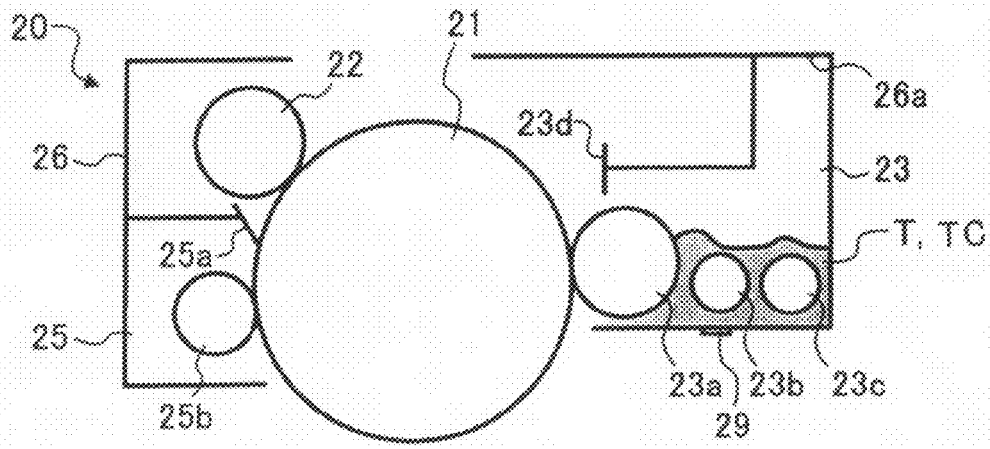
FIG. 2A is a section showing a process cartridge in a condition before mounting to the apparatus of FIG. 1.
Figure 2B:
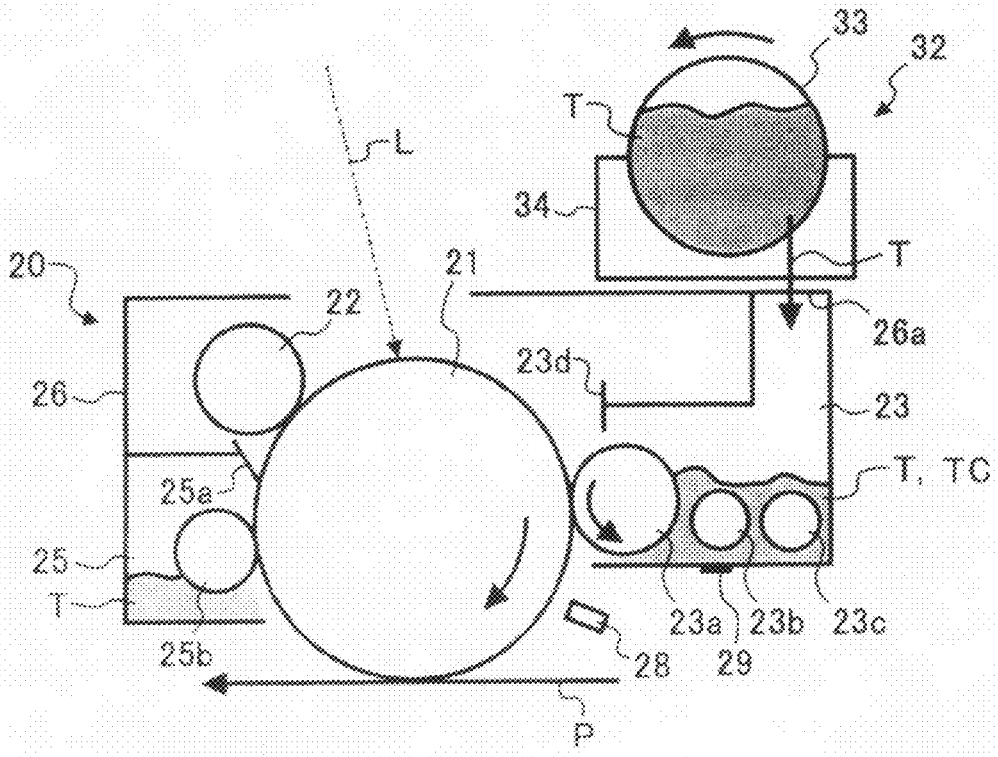
FIG. 2B is a view similar to FIG. 2A, showing the process cartridge in a condition after mounting to the apparatus of FIG. 1.
Figure 3:
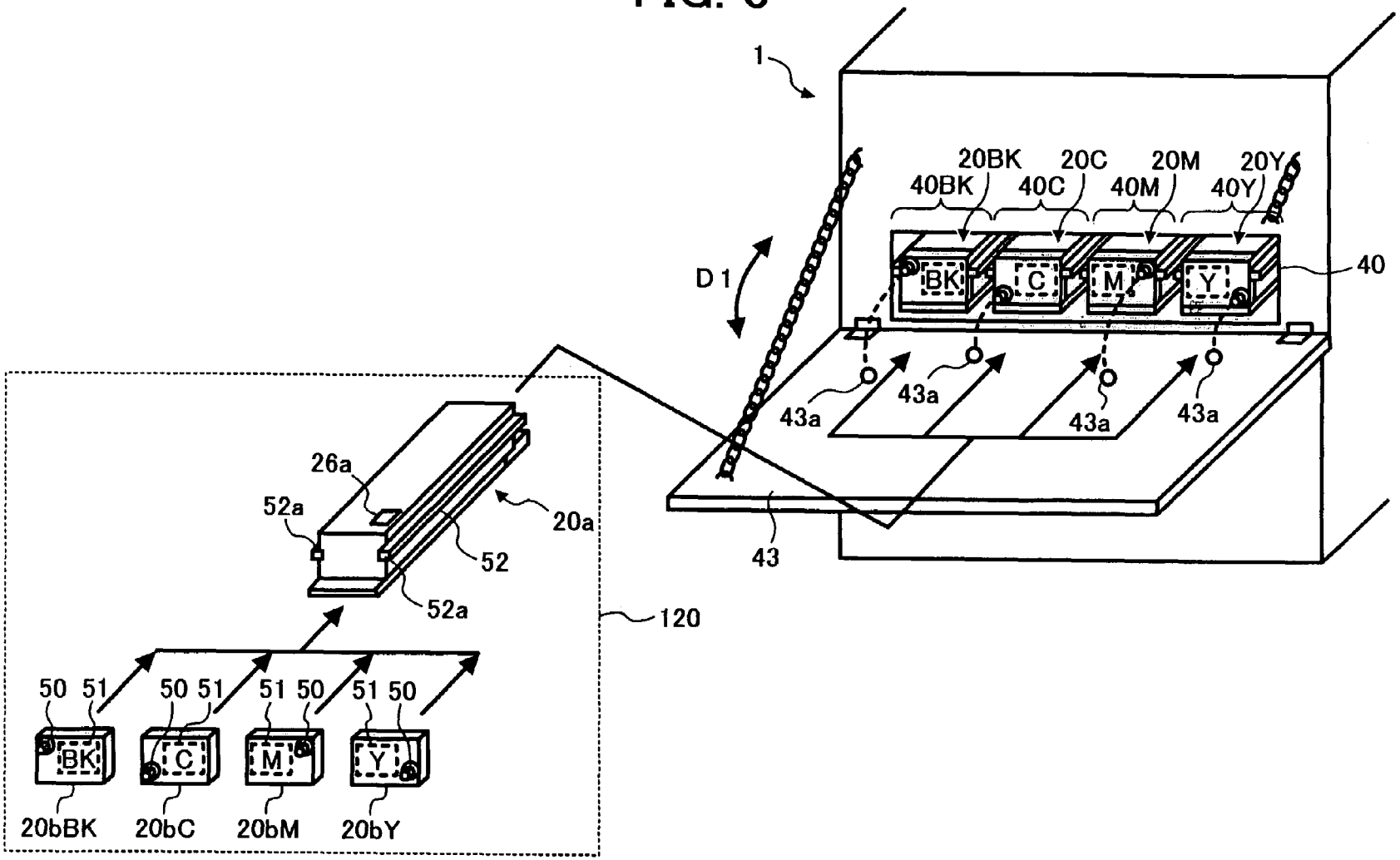
FIG. 3 is a perspective view showing the arrangement of process cartridges mounted to the apparatus of FIG. 1.

Referring to FIGS. 1 through 3, an image forming apparatus embodying the present invention is shown. First, the general construction and operation of the illustrative embodiment will be described with reference to FIG. 1. As shown, the color laser printer (simply printer hereinafter) includes a printer body or apparatus body 1 and optics or writing section 2 configured to emit laser beams in accordance with image data. Process cartridges 20Y (yellow), 20M (magenta), 20C (cyan) and 20BK (black) each are located at a position corresponding to a particular color.

A photoconductive drum or image carrier 21 is mounted on each of the process cartridges 20Y through 20BK. Arranged around the drum 21 are a charger 22 for uniformly charging the surface of the drum 21, a developing device 23 for developing a latent image electrostatically formed on the drum 21 with toner, an image transfer roller 24 for transferring the resulting toner image from the drum 21 to a sheet or recording medium P, and a cleaning device 25 for collecting toner left on the drum 21 after the image transfer. An endless belt 30 is included in a belt unit. Toner replenishing sections 32Y, 32M, 32C and 32BK are so arranged as to replenish yellow, magenta, cyan and black toners to the developing devices 23 of the process cartridges 20Y, 20M, 20C and 20BK, respectively. A sheet feeding section 61 is loaded with a stack of sheets P. A fixing unit 66 is positioned downstream of the belt unit.

The process cartridges 20Y through 20BK each include a casing supporting the respective drum 21, charger 22, developing device 23 and cleaning device 25. In each of the process cartridges 20Y through 20BK, an image is formed on the drum 21 in a particular color, i.e., yellow, magenta, cyan or black.

The operation of the printer in a color mode will be described hereinafter. While each of the four drums 21 are rotated clockwise as viewed in FIG. 1, the charger 22 assigned to the drum 21 uniformly charges the surface of the drum 21. Subsequently, the charged surface of the drum 21 reaches a position to which a laser beam is incident.

On the other hand, the optics 2, arranged in the upper portion of the printer body 1, includes a light source for emitting laser beams each corresponding to image data of a particular color. Each laser beam thus emitted from the light source is reflected by a polygonal mirror 3, which is spinning, and then sequentially passed through lenses 4 and 5. The laser beam is then propagated through a particular path assigned to the respective color.

More specifically, a laser beam corresponding to a yellow component is sequentially reflected by mirrors 6, 7 and 8 and then incident to the charged surface of the drum 21 included in the first process cartridge 20Y, as counted from the right in FIG. 1. As a result, a latent image representative of the yellow component is formed on the charged surface of the drum 21. Likewise, a laser beam corresponding to a magenta component is sequentially reflected by mirrors 9, 10 and 11 and then incident to the charged surface of the drum 21 included in the second process cartridge 20M next to the process cartridge 20Y, forming a latent image representative of the magenta component. A laser beam corresponding to a cyan component is sequentially reflected by mirrors 12, 13 and 14 and then incident to the charged surface of the drum 21 included in the third process cartridge 20C next to the process cartridge 20M, forming a toner image representative of the cyan component. Further, a laser beam corresponding to a black component is reflected by a mirror 15 and then incident to the charged surface of the drum 21 included in the fourth or leftmost process cartridge 20BK, forming a latent image representative of the black component.

When the surface of each drum 21, carrying the respective latent image thereon, is brought to a position where it faces the developing device 23 assigned to the drum 21, the developing device 23 deposits toner of a particular color on the latent image to thereby produce a corresponding toner image.

More specifically, in the first process cartridge 20Y, the developing device 23 develops the latent image formed on the associated drum 21 with yellow toner replenished from the toner replenishing section 32Y, thereby producing a yellow toner image. Likewise, in the second process cartridge 20M, the developing device 23 develops the latent image formed on the associated drum 21 with magenta toner replenished from the toner replenishing section 32M, thereby producing a magenta toner image. In the third process cartridge 20C, the developing device 23 develops the latent image formed on the associated drum 21 with cyan toner replenished from the toner replenishing section 32C, thereby producing a cyan toner image. Further, in the fourth process cartridge 20BK, the developing device 23 develops the latent image formed on the associated drum 21 with block toner replenished from the toner replenishing section 32BK, thereby producing a black toner image.

Subsequently, the surfaces of the drums 21, carrying the respective toner images thereon, are brought to positions where they face the belt 30. The image transfer rollers 24 each are positioned to face a particular drum 21 and held in contact with the inner surface of the belt 30. In this condition, the toner images of different colors carried on the drums 21 are sequentially transferred to the sheet P, which is being conveyed by the belt 30, one above the other by the consecutive image transfer rollers 24, completing a composite or color image on the sheet P.

In the belt unit, the belt 30 is passed over a drive roller and three driven rollers and is driven by the drive roller to turn in a direction indicated by an arrow in FIG. 1. The belt 30, image transfer rollers 24 and so forth are integrally mounted on the belt unit, constituting an image transferring section or image transferring means in the image forming process.

After the image transfer stated above, the surface of each drum 21 is brought to a position where it faces the cleaning device 25 assigned thereto. The cleaning device 25 collects residual toner left on the drum 21 after the image transfer. Thereafter, the surface of the drum 21 is discharged by a discharger, not shown, and prepared for the next image formation thereby.

On the other hand, the sheet P is paid out from the sheet feeding section 61 by a pickup roller 62 and then guided to a registration roller pair 64 by a guide 63. The registration roller pair 64 stops the sheet P and then drives it toward a nip between the belt 30 and an adhesion roller 27 at preselected timing. Subsequently, the sheet P is conveyed by the belt 30 via the four consecutive drums 21 in the direction indicated by the arrow, so that the toner images of different colors are sequentially transferred to the sheet P, as stated previously.

The sheet P thus carrying the color image thereon is separated from the belt 30 and then brought to the fixing unit 66. In the fixing unit, a heat roller 67 and a press roller 68 fix the color image on the sheet P with heat and pressure. Subsequently, the sheet P is driven out of the printer body 1 by an outlet roller pair 69. This is the end of operation of the printer 1.

Reference will be made to FIGS. 2A, 2B and 3 for describing the process cartridges 20Y through 20BK unique to the illustrative embodiment specifically. In FIGS. 2A and 2B, prefixes Y through BK are omitted.

As shown in FIG. 2A, a casing 26 included in each process cartridge 20 accommodates at least the drum or image carrier 21, charger 22, developing device 23 and cleaning device 25. The process cartridge 20 is configured to be bodily removable by hand. The developing device 23 includes a developing roller 23*a*, two agitators 23*b* and 23*c* implemented as rollers, a doctor blade 23*d* and a permeability sensor 29. A two-ingredient type developer, i.e., a mixture of toner T and carrier TC is stored in the developing device 23 before the process cartridge 20 is mounted to the printer body 1. The cleaning device 25 includes a cleaning blade 25*a* pressed against the drum 21 by preselected pressure and a cleaning roller 25*b*. The charger, implemented as a charge roller by way of example, is also pressed against the drum 21 by preselected pressure. The process cartridge 20 with the above configuration is mounted to a preselected mount portion included in the printer body 1, as shown in FIG. 2.

More specifically, as shown in FIG. 3, when a person opens a door 43 hinged to the printer body 1 in a direction indicated by an arrow D1, an opening 40 is uncovered and makes four mount portions 40Y, 40M, 40C and 40 BK accessible from the outside. The person then mounts the process cartridges 20Y through 20BK different in the color of toner from each other to the mount portions 40Y through 40BK, respectively.

More specifically, in the illustrative embodiment, the mount portions 40Y through 40BK each include rails or guide members for guiding associated one of the process cartridges 20Y through 20BK into the printer body 1. As shown in FIG. 2B, each process cartridge 20 thus mounted to the printer body 1 has a toner inlet 26*a* thereof brought into engagement with the toner replenishing section 32 affixed to the printer body 1. Further, a drive transmitting portion included in the toner cartridge 20 is operatively connected to a driving section located at the rear end of the printer body 1, although not shown specifically.

The four toner replenishing sections 32 arranged on the printer body 1 each include a replaceable toner bottle 33 and a bottle holder 34 supporting and rotating the toner bottle 33. The toner bottle 33 stores any one of yellow, magenta, cyan and black toners T therein. Such toner is replenished from the bottle holder 34 to the developing device 23 of the process cartridge 20.

The image forming process to occur after the mounting of the process cartridges 20Y through 20BK to the printer body 1 will be described more specifically with reference to FIG. 2B. A laser beam L is reflected incident to the charged surface of the drum 21 included in the process cartridge 20. As a result, a latent image representative of the corresponding component is formed on the charged surface of the drum 21. In the developing device 23, the developing roller 23*a* is rotated in a direction indicated by an arrow in FIG. 2B. At the same time, the agitators or rollers 23*b* and 23*c* are rotated counterclockwise, as viewed in FIG. 2B, to mix the toner T fed from the toner replenishing section 32 with the toner T and carrier TC present in the developing device 23 while agitating them. The toner T charged by such agitation is deposited on the developing roller 23*a* by the agitator 23*b* together with the carrier TC.

It is to be noted that the toner T in the toner bottle 33 is replenished to the developing device 23 via the toner inlet 26*a* at adequate timing as the toner T in the developing device 23 is consumed little by little. The consumption of the toner T present in the developing device 23 is sensed by the permeability sensor 29 disposed in the device 23 and a reflection type optical sensor 28 facing the drum 21.

The developing roller 23*a* in rotation conveys the toner T deposited thereon to a developing zone where it faces the drum 21 by way of a position where the doctor blade 23*d* is located. In the developing zone, the toner T is transferred from the developing roller 23*a* to a latent image formed on the drum 21 by an electric field, forming a toner image corresponding to the latent image. More specifically, the toner T is deposited on the drum 21 on the basis of a difference between the potential of the latent image present on the drum 21 and a bias for development applied to the developing roller 23*a*.

The toner left on the drum 21 after the image transfer is removed by the cleaning blade 25*a* and cleaning roller 25*b* and collected in the cleaning device 25 as waste toner T.

As shown in FIG. 3, the process cartridges 20Y through 20BK each are made up of a cartridge body 20*a* and one of plate members or identification members 20*b*Y, 20*b*M, 20*b*C and 20*b*BK fitted on the cartridge body 20*a*. Such cartridge bodies 20*a* have an identical configuration and are distinguished from each other by the plate members 20*b*Y through 20*b*BK different in configuration from each other.

More specifically, the cartridge body 20*a* is loaded with most of major members included in the process cartridge 20 shown in FIG. 2A. The plate members 20*b*Y through 20*b*BK each are provided with visible information 51 and a projection 50 that allow a person to see the color of toner stored in the process cartridge 20 when mounting the process cartridge 20 to the printer body 1. For example, the plate member 20*b*Y indicative of yellow toner is provided with letter Y, which is visible information, and the projection 50 positioned at the bottom right portion as seen from the front. Likewise, the plate member 20*b*M indicative of magenta toner is provided with letter or visible information M and the projection 50 positioned at the top right portion. The plate member 20*b*C indicative of cyan toner is provided with letter or visible information C and the projection 50 positioned at the bottom left portion. Further, the plate member

20*b*BK indicative of black toner is provided with letter or visible information BK and the projection 50 positioned at the top left portion.

The plate members 20*b*Y through 20*b*BK different in configuration from each other, as stated above, each are fitted on the front end of one of the identical cartridge bodies 20*a* in the direction of mounting. Then, after the developers of different colors have been filled in the process cartridges 20Y through 20BK, the process cartridges 20Y through 20BK are mounted to the mount portions 40Y through 40BK, respectively. The plate members 20*b*Y through 20*b*BK each are held by retaining portions 52*a* formed at one end of engaging members 52 that extend on opposite side walls of the cartridge body 20*a*. The retaining portions 52*a* mate with the rails of any one of the mount portions 40Y through 40BK.

The process cartridges 20Y through 20BK identical with each other and provided with the non-identical plate members 20*b*Y through 20*b*BK, respectively, can be mounted to the printer body 1 only if the plate members 20*b*Y through 20*b*BK match in configuration with the mount portions 40Y through 40BK, respectively. More specifically, the door 43 is formed with holes 43*a* each corresponding in position to the projection 50 of particular one of the plate members 20*b*Y through 20BK. In this configuration, the process cartridges 20Y through 20BK can be fully set on the printer body 1, i.e., the door 43 can be fully closed only if the projections 50 of the plate members 20*b*Y through 20*b*BK all mate with the holes 43*a* of the door 43.

Stated another way, the mount portions 40Y through 40BK each allow only one process cartridge storing toner of a particular color to be mounted thereto. This successfully prevents a person from confusing one process cartridge for another and therefore enhances reliability of the printer.

Further, in the illustrative embodiment, the plate members 20*b*Y through 20*b*BK each are provided with the particular visible information 51 in addition to the particular shape, allowing a person to see the positions where the process cartridges should be located by eye also. Of course, the visible information 51 is not limited to letters, but may be implemented by colors, marks or combinations thereof.

As shown in FIG. 3, the cartridge body 20*a* and four plate members 20*b*Y through 20*b*BK are stocked by the manufacturer or the distributor as a packed kit 120. When the user of the printer sends an order to the manufacturer or the distributor for one or more process cartridges for replacement, the manufacturer or the distributor prepares and delivers a packed kit or kits 120 to the user. On receiving the kit 120, the user fits one of the plate members 20*b*Y through 20*b*BK, which corresponds to the color of toner to replace, on the cartridge body 20*a* for thereby completing a process cartridge. Subsequently, the user sets a desired developer in the process cartridge and then mounts the process cartridge to adequate one of the mount portions 40Y through 40BK of the printer body 1.

As stated above, in the illustrative embodiment, the cartridge body 20*a* and four plate members 20*b*Y through 20*b*BK are packed up together to constitute a kit 120 ready to be delivered. This successfully reduces the number of articles subject to inventory control for thereby promoting efficient delivery. Further, the overall production cost is low because the cartridge bodies 20*a* of all process cartridges are identical in configuration with each other and because the plate members 20*b*Y through 20*b*BK are extremely simple in structure and low cost although they are not identical with each other.

In the illustrative embodiment, the plate members 20*b*Y through 20BK each are provided with one projection 50 at a particular position for distinction. If desired, the projections 50 may be replaced with holes or notches formed in the plate members 20*b*Y through 20BK at different positions from each other, in which case projections will be formed in the door 43 of the printer body 1 in matching relation to the holes or the notches.

Second Embodiment

Figure 4A:
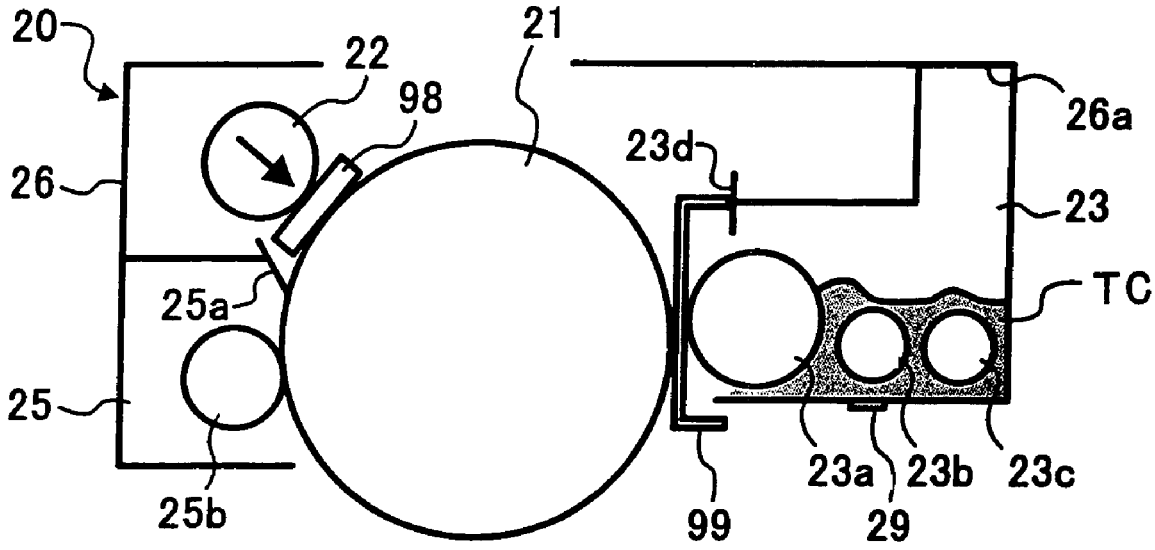
FIG. 4A is a section showing a process cartridge representative of a second embodiment of the present invention.
Figure 4B:
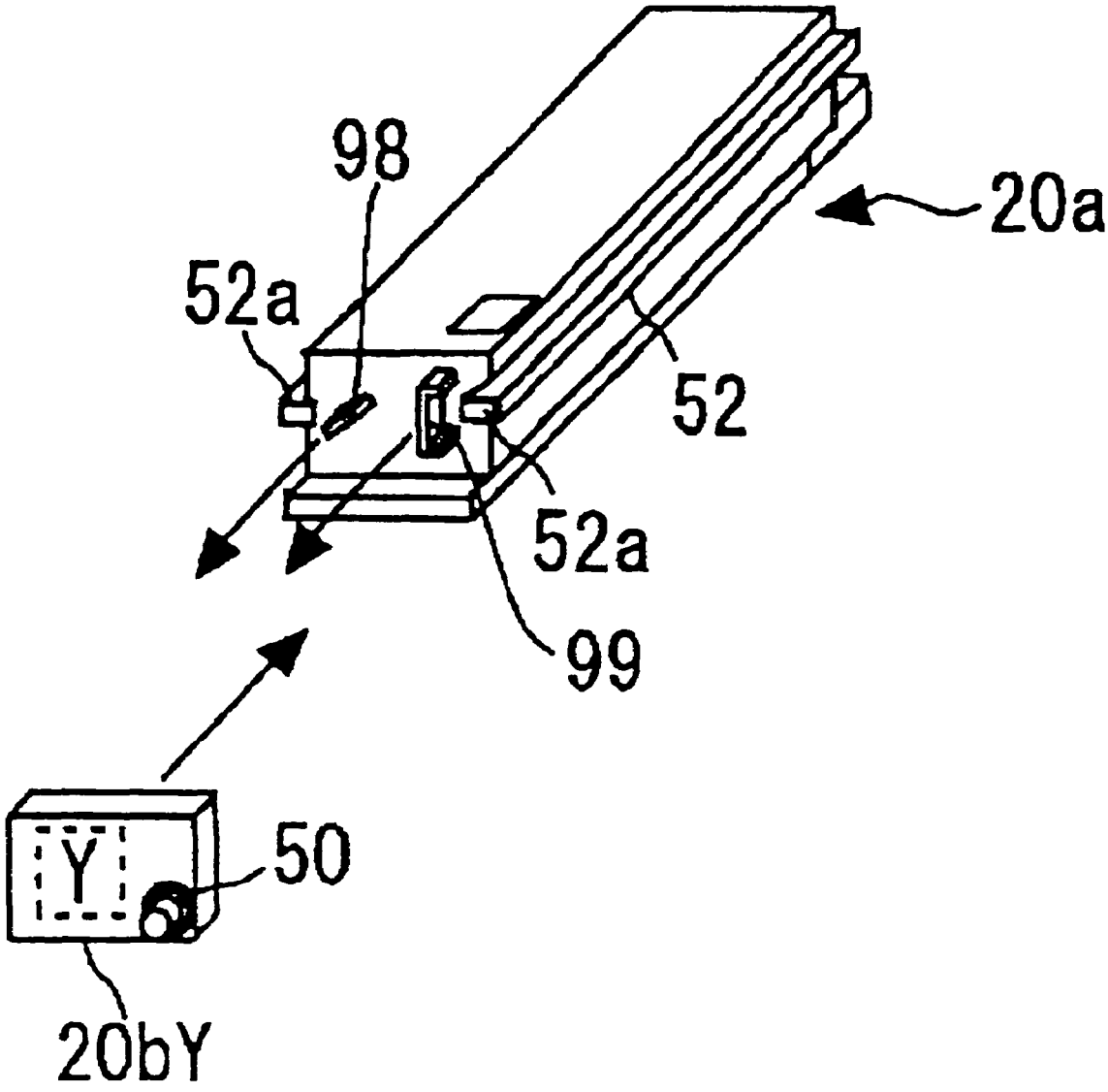
FIG. 4B is a perspective view showing a cartridge body and an identification member included in the second embodiment.

Referring to FIGS. 4A and 4B, a process cartridge 20 representative of a second embodiment of the present invention will be described. The second embodiment mainly differs from the first embodiment in that regulating members for regulating operation in the printer body, not shown, are positioned in each process cartridge when the process cartridge is new and in that a developer is stored in the developing device of the new process cartridge beforehand.

More specifically, as shown in FIG. 4A, a wedge or regulating member 98 is disposed in the process cartridge 20 that is new or subject to inventory control. The wedge 98 contacts the non-image portion of the drum 21 and that of the charge roller 22 in order to control their distance. In this condition, the wedge 98 prevents the charge roller 22 from remaining in direct contact with the drum 21 over a long period of time, thereby obviating creep.

Further, a seal member or another regulating member 99 is positioned in the new process cartridge 20 and adhered to the edges of an opening, not shown, formed in the developing device 23; the developing roller 23*a* faces the drum 21 via the above opening. In this condition, the seal member 99 prevents the developer stored in the developing device 23 beforehand from depositing on and scratching the drum 21 or flying out of the developing device 23.

It should be noted that in the illustrative embodiment the developing device 23 stores only the carrier TC, which is applicable to toner of any color, when the process cartridge 20 is new. More specifically, the cartridge body 20*a*, storing the carrier TC beforehand, is applicable to toner of any color.

As shown in FIG. 4B, after a particular plate member, e.g., the plate member 20*b*Y indicative of yellow toner has been fitted on the cartridge body 20*a*, yellow toner is filled in the developing device 23. The resulting process cartridge 20Y is mounted to the mount portion 40Y of the printer body not shown.

In the illustrative embodiment, the plate member 20*b*Y cannot be fitted on the cartridge body 20*a* unless the wedge 98 and seal member 99 are removed from the cartridge body 20*a*. More specifically, the end of the wedge 98 and that of the seal member 99 protrude from the end face of the cartridge body 20*a* assigned to the plate member 20*b*Y in such a manner as to interfere with plate member 20*b*Y. In this configuration, the plate member 20*b*Y can be fitted on the cartridge body 20*a* only after the wedge 98 and seal member 99 have been removed from the cartridge body 20*a* in a direction indicated by an arrow in FIG. 4B.

As stated above, the illustrative embodiment, like the first embodiment, allows the user of the printer to fit the particular plate member or identification member 20*b*Y on any cartridge body 20*a*. It is therefore possible to obviate erroneous replacement of the process cartridge 20 and to reduce costs necessary for inventory control, production and delivery. Further, the user should remove the regulating members 98 and 99 before fitting the plate member 20*b*Y on the cartridge body 20*a*, i.e., the regulating members 98 and 99 are surely removed before the process cartridge 20 is mounted to the printer body.

While the regulating members are implemented as the wedge 98 configured to control the gap of the charge roller 22 and the seal member 99 configured to prevent toner from flying out in the illustrative embodiment, such regulating members are only illustrative. For example, a pressure canceling member for canceling contact pressure between the cleaning blade 25*a* and the drum 21 may be used as a regulating member that protects the cleaning blade 25*a* from creep. In addition, a gap member for regulating the distance between the developing roller 23*a* and the drum 21 may be used as another regulating member that protects the developing roller 23*a* from creep. Such an alternative regulating member is also removed from the cartridge body 20*a* before the plate member or identification member 20*b* is fitted on the cartridge body 20*a*.

Third Embodiment

Figure 5:
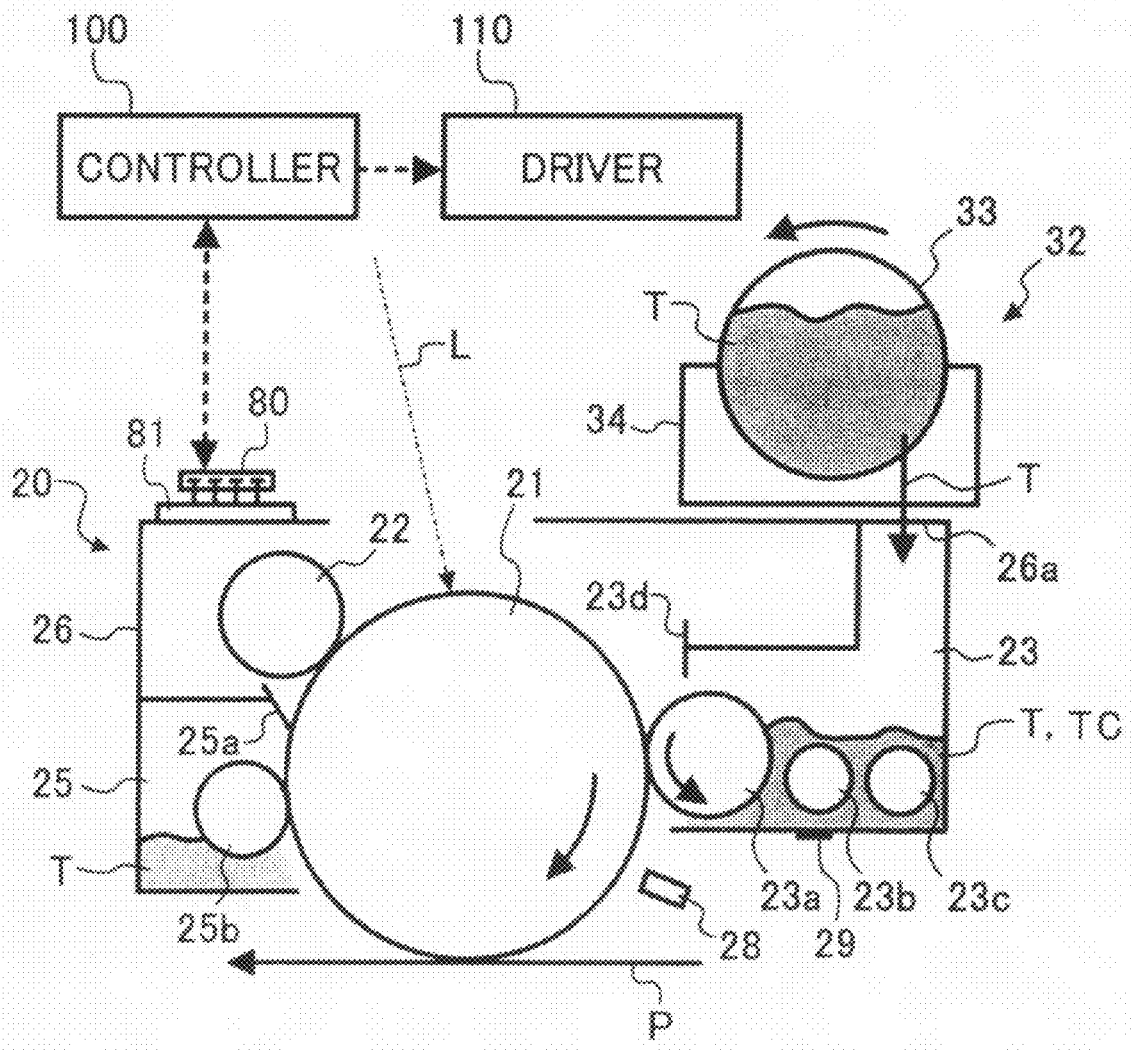
FIG. 5 is a section showing a process cartridge representative of a third embodiment of the present invention.

FIG. 5, corresponding to FIG. 2B, shows a process cartridge 20 representative of a third embodiment of the present invention and mounted on the printer body not shown. As shown, the illustrative embodiment is essentially similar to the first embodiment except that a nonvolatile memory 80 is substituted for the plate member or identification member 20*b*.

As shown in FIG. 5, the nonvolatile memory 80 is mounted on the process cartridge 20 as another specific identification member. More specifically, an NV-RAM (NonVolatile Random Access Memory), RFID (Radio Frequency IDentification) chip or similar nonvolatile memory 80 is positioned on a socket 81 affixed to the casing 26. Information indicative of the kind of a developer, i.e., the color of toner stored in the process cartridge 20 is stored in the memory 80 beforehand.

When the process cartridge 20 is mounted to any one of the mount portions, not shown, of the printer body 1, a controller or comparing section 100 included in the printer body 10 examines the information stored in the memory 80. If the information shows that the process cartridge 20 is proper for the mount portion, the controller 100 reports the proper state to a driver 110 for thereby preparing the process cartridge 20 for operation. On the other hand, if the process cartridge 20 is not proper for the above mount portion, the controller 100 reports the improper state to the driver 110 for thereby making the process cartridge 20 unable to operate.

In the illustrative embodiment, the user of the printer may inadvertently mount an improper process cartridge 20 to any mount portion because the plate members 20 different in configuration from each other are not used. However, the illustrative embodiment does not allow the improper process cartridge 20 from operating on the mount portion by checking the information stored in the memory 80.

In the illustrative embodiment, the process cartridge 20 on which the nonvolatile memory 80 is not mounted constitutes a cartridge body to which toner of any color is applicable. Four nonvolatile memories 80 and a single process cartridge or cartridge body are packed up together as a kit, as in the first embodiment.

As stated above, the illustrative embodiment is also successful to obviate erroneous replacement of the process cartridge 20 and to reduce costs necessary for inventory control, production and delivery.

If desired, the nonvolatile memory 80 may be configured to allow information other than the information representative of the color of toner to be additionally stored. For example, information representative of the operation history of the process cartridge 20 may be written to the memory 80, so that image forming conditions optimal for the process cartridge 20 can be set or the life of structural members can be controlled.

Further, the color-by-color information stored in the nonvolatile memory or identification member 80 may be replaced with information capable of being electrically or optically recognized. For example, the identification member may be implemented as a dip switch mounted on the process cartridge 20, in which case the controller 100 of the printer body 1 will electrically recognize the setting of the dip switch to thereby determine the kind of the process cartridge 20. Alternatively, the identification member may be implemented as a seal adhered to the casing 26 of the process cartridge 20 and provided with, e.g., particular density indicative of the color of toner. Such a seal will be recognized by the controller 100 via an optical sensor also mounted on the printer body 1.

Fourth Embodiment

Figure 6:
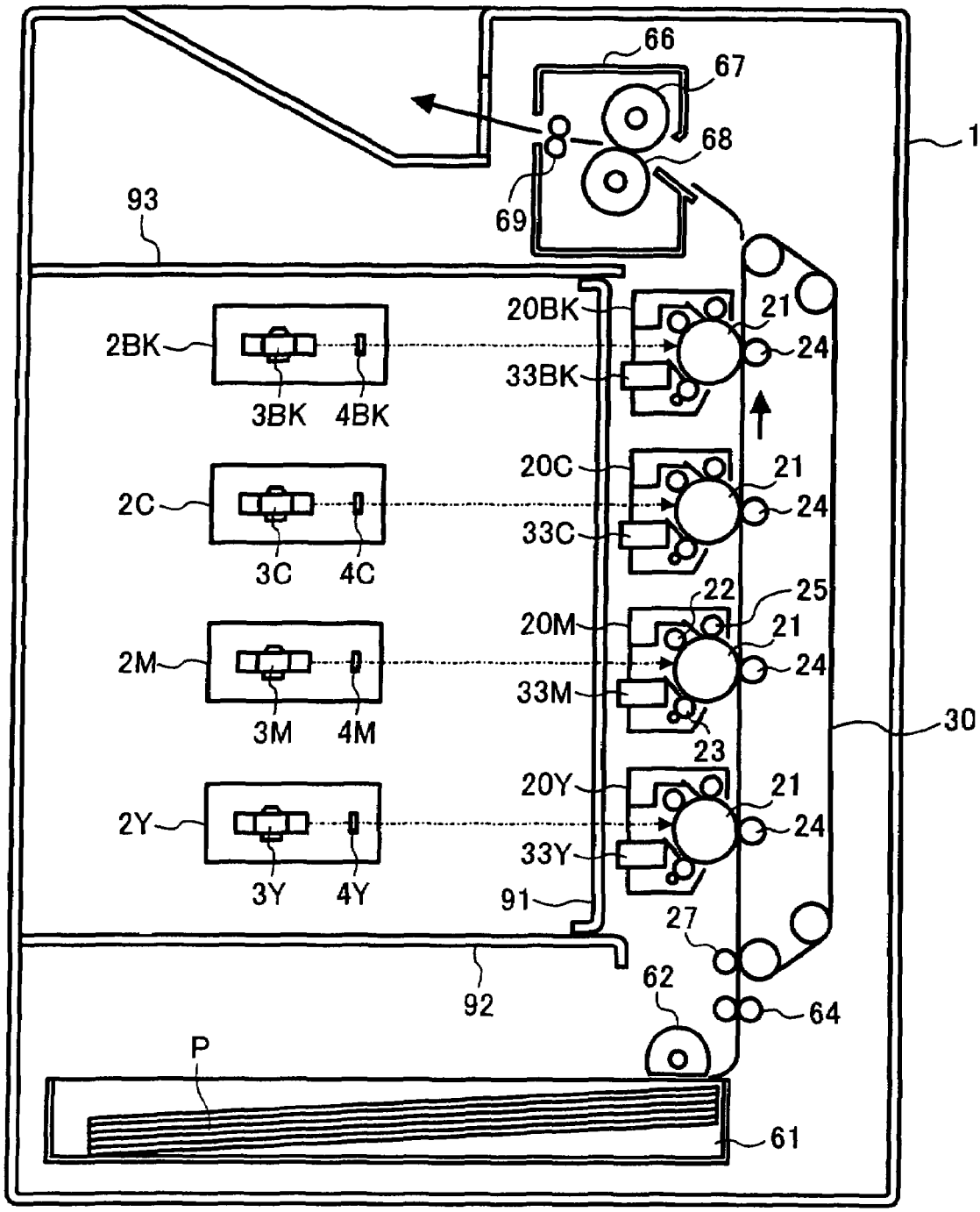
FIG. 6 is a view showing the general construction of an image forming apparatus representative of a fourth embodiment of the present invention.
Figure 7:
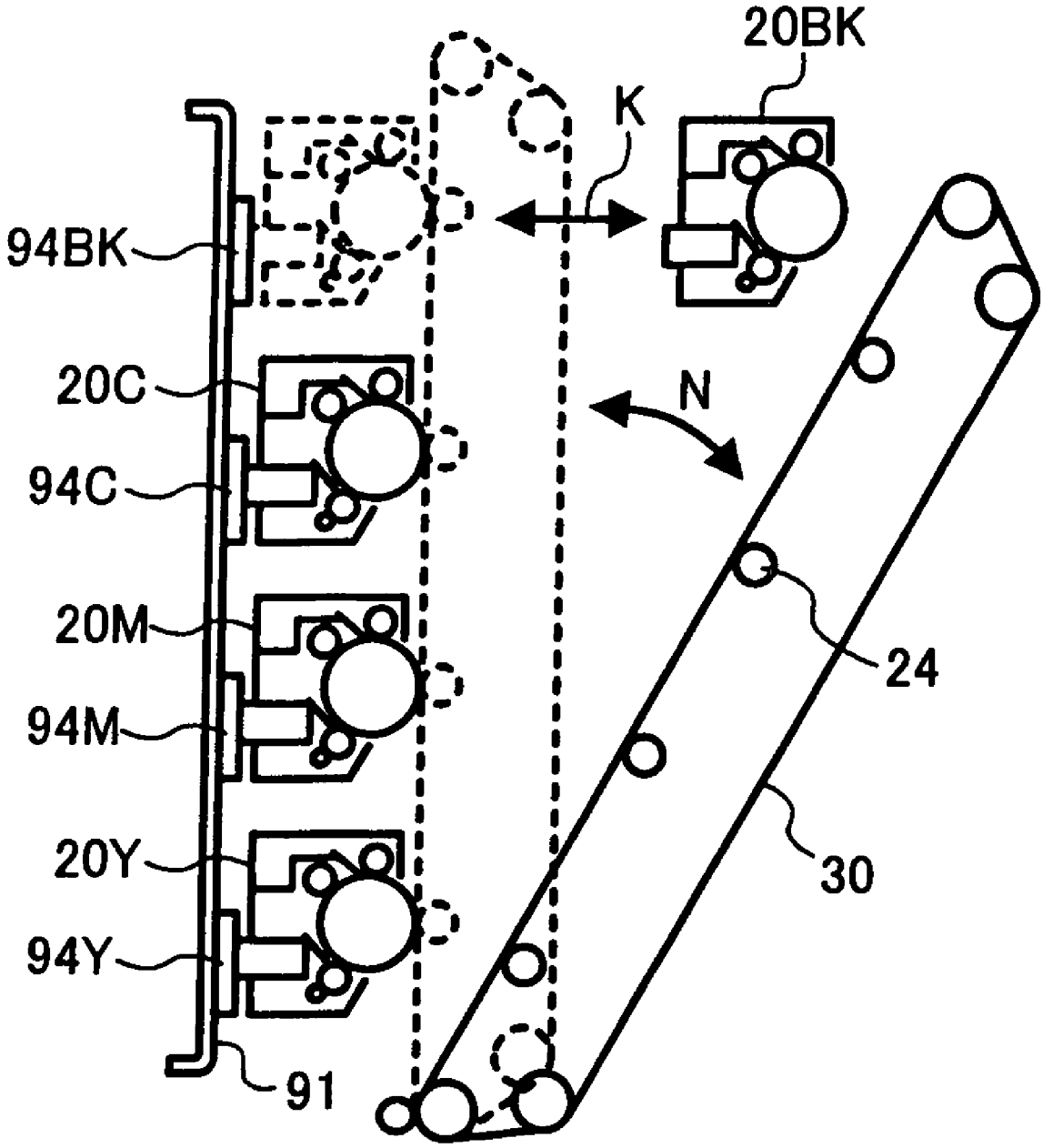
FIG. 7 is a section demonstrating how process cartridges are mounted to the apparatus of FIG. 6.
Figure 8:
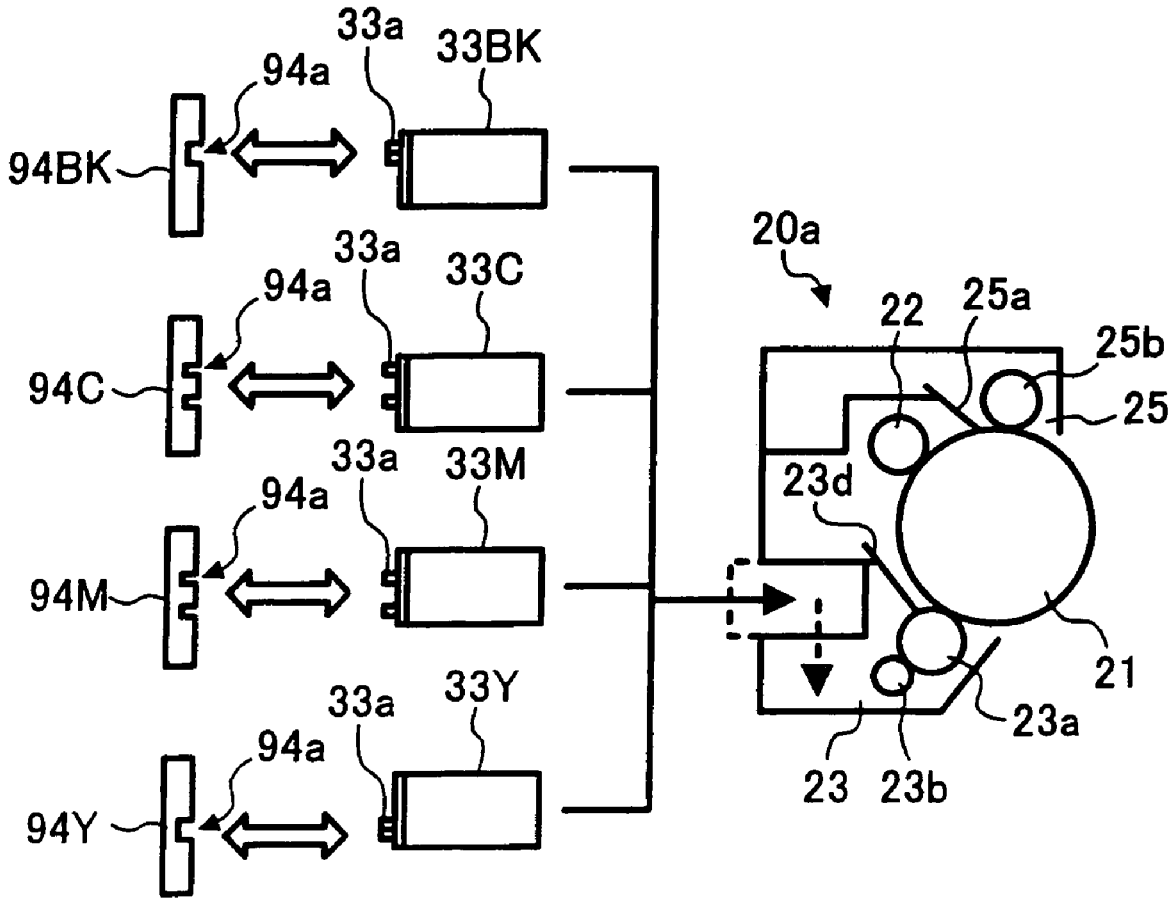
FIG. 8 is a view showing the configuration of the process cartridge included in the fourth embodiment.

Reference will be made to FIGS. 6 through 8 for describing a fourth embodiment of the present invention. Briefly, the fourth embodiment differs from the first embodiment mainly in that a process cartridge is mounted to the printer body 1 in a different direction and in that an identification member is provided on a toner bottle.

FIG. 6 is a view corresponding to FIG. 1, showing the general construction of the printer of the illustrative embodiment. As shown, the four process cartridges 20Y through 20BK and four optics 2Y through 2BK associated therewith are arranged in parallel in the direction of height. A laser beam, issuing from any one of the optics 2Y through 2BK, which respectively include polygonal mirrors 3Y through 3BK and lenses 4Y through 4BK, and representative of image data of particular color, is incident to the drum 21 of preselected one of the process cartridges 20Y through 20BK. Toner images of different colors are formed on the drums 21 of the process cartridges 20Y through 20BK in the same manner as in the first embodiment and then sequentially transferred to the sheet P, which is conveyed by the belt 30 in a direction indicated by an arrow in FIG. 6. The sheet P, thus carrying a color image thereon, is driven out of the printer body 1 via the fixing unit 66.

As shown in FIG. 7, in the illustrative embodiment, the process cartridges 20Y through 20BK are not mounted or dismounted in the longitudinal direction, but are mounted or dismounted in the lateral direction perpendicular to the longitudinal direction. More specifically, assuming that the side where the drum 21 of each process cartridge is exposed to the outside is the front side or operation side, then the process cartridge is mounted or dismounted in a direction indicated by a double-headed arrow K in FIG. 7.

To mount or dismount any one of the process cartridges 20Y through 20BK, the operator opens a door, not shown, hinged to the printer body 1 and then angularly moves the belt unit, which includes the transfer rollers 24 and belt 30, about a shaft portion in a direction indicated by an arrow N in FIG. 7.

On the other hand, a side plate 91 is located at the rear side, or the left side as viewed in FIG. 7, and supported by a top plate 93 and a bottom plate 92, see FIG. 6. Engaging portions 94Y, 94M, 94C and 94BK are positioned on the side plate 91, and each corresponds to a particular mount portion. The process cartridges 20Y through 20BK are mounted to the side plate 91 by being engaged with the engaging portions 94Y through 94BK, respectively.

As shown in FIG. 8, the toner bottles 33Y through 33BK are formed with projection 33*a* different in configuration from each other and indicative of toner of a particular color each. The engaging portions 94Y through 94BK, located at the respective mount portions, each are formed with a hole 94*a* configured to mate with particular one of the projections 33*a*. Therefore, in the illustrative embodiment, the toner bottles 33Y through 33BK play the role of identification members.

As shown in FIG. 8, after any one of the toner bottles or identification members 33Y through 33BK has been mounted to the cartridge body 20*a* of applicable to toner of any color, the process cartridge is mounted to preselected one of the engaging portions 94Y through 94BK.

In the illustrative embodiment, a one-ingredient type developer or toner is applied to the developing device 23, i.e., a developer or toner is absent in the developing device 23 of the cartridge body 20*a* when the process cartridge 20 is new. In the illustrative embodiment, before the toner cartridge 20 is mounted to the printer body 1, one of the toner bottles 33Y through 33BK is set on the cartridge body 20*a* so as to feed toner to the developing device 23, as indicated by a dotted arrow in FIG. 8.

As stated above, the illustrative embodiment also allows only a proper process cartridge 20 to be mounted to each mount portion and therefore obviates erroneous replacement to thereby enhance the reliability of the printer.

Fifth Embodiment

Figure 9A:
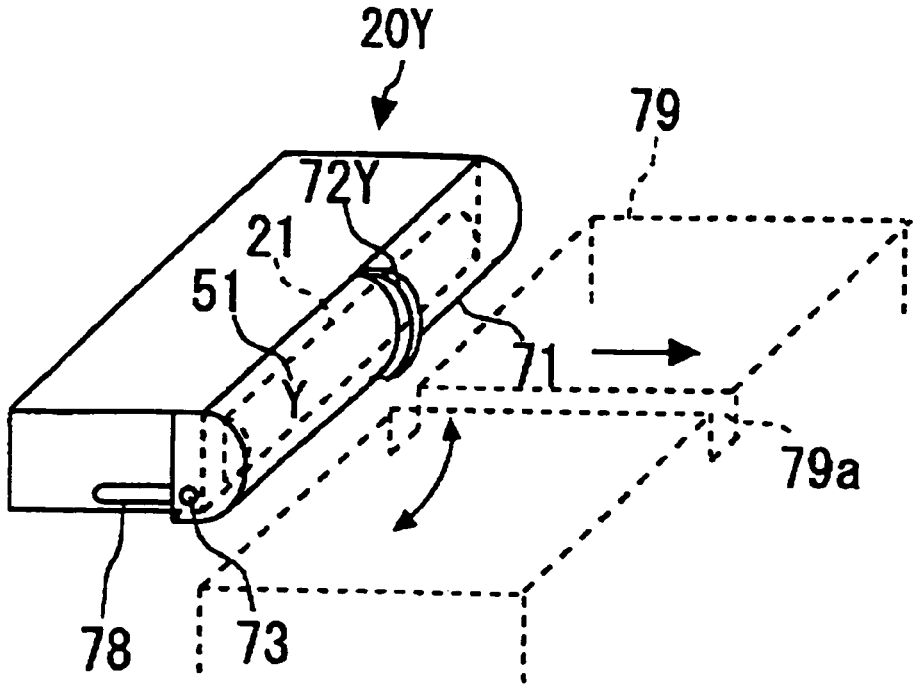
FIG. 9A is a perspective view showing a process cartridge representative of a fifth embodiment of the present invention in a condition before mounting to an image forming apparatus.

A fifth embodiment of the present invention will be described with reference to FIGS. 9A and 9B. This embodiment is essentially similar to the first embodiment except that each process cartridge is mounted to the printer body in a different direction and in that the identification member is formed integrally with a protection member that protects the drum 21. FIG. 9A shows, e.g., the process cartridge 20Y in a condition before mounting the mount portion while FIG. 9B shows the process cartridge 20Y in a condition after mounting to the same.

Figure 9B:
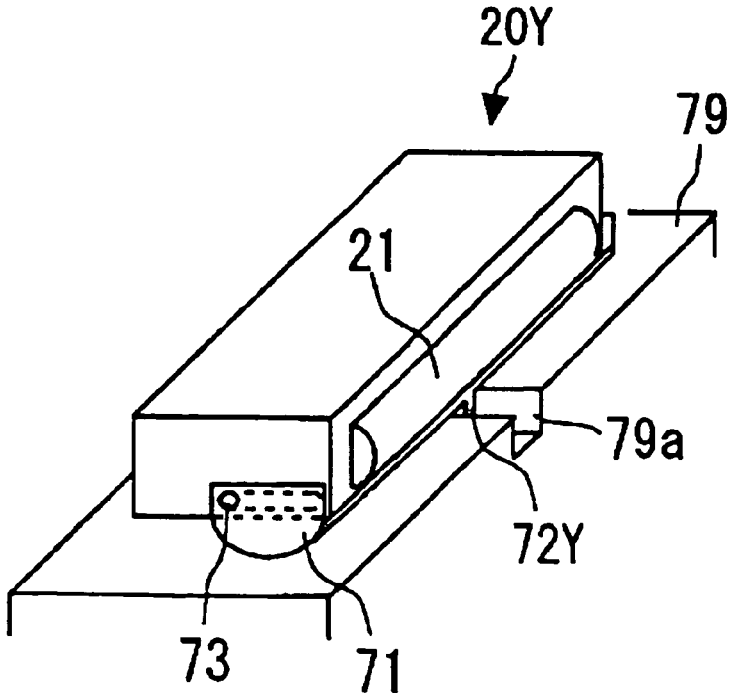
FIG. 9B is a perspective view showing a process cartridge representative of a fifth embodiment of the present invention in a condition after before mounting to an image forming apparatus.

As shown in FIGS. 9A and 9B, a protection member 71 is mounted on the process cartridge 20Y in such a manner as to uncover the drum 21 in interlocked relation to the mounting operation. More specifically, as shown in FIG. 9A, before the process cartridge 20Y is set on a mount portion 79, the opening of the process cartridge 20Y adjoining the drum 21 remains closed by the protection member 71. In this condition, the protection member 71 protects the drum 21 not set on the printer body from optical fatigue and scratches.

As shown in FIG. 9B, when the process cartridge 20Y is set on the mount portion 79, the protection member 71 is automatically retracted to uncover the opening adjoining the drum 21, as will be described more specifically later. In this condition, the printer is capable of executing the image forming process with the drum 21.

In the illustrative embodiment, the process cartridge 20Y is mounted to the printer body in the lateral direction with the drum 21 being positioned at the rear side in the direction of operation, as indicated by an arrow in FIG. 9A. The protection member 71 is formed with an engaging member 72Y while the mount portion 79 is formed with a guide member 79*a* implemented as a groove. The process cartridge 20Y is mounted to the mount portion 79 with the engaging member 72Y being received in the guide member 79*a*. At this instant, the protection member 71 is moved to uncover the opening of the process cartridge 20Y.

More specifically, the protection member 71 is angularly movably supported by a shaft 73, which is, in turn, movably received in a guide slot 78 formed in the process cartridge 20Y. In this configuration, when the process cartridge 20Y is moved toward the rear side of the mount portion 79, i.e., rightward in FIG. 9A, the shaft 73 is restricted by an abutment, not shown, included in the mount portion 79 and caused to move along the guide slot 78 thereby. When the shaft 73 fully moves in the guide groove 78, the protection member 71 fully uncovers the opening of the process cartridge 20Y.

In the illustrative embodiment, the position of the engaging member 72Y of the protection member 71 in the longitudinal direction is dependent on the color of toner stored in the process cartridge 20Y, although not shown specifically. Also, the position of the guide member or groove 79*a* formed in the mount portion 79 is dependent on the color of toner in matching relation to the position of the engaging member 72Y. That is, the protection member or identification member 71 is provided on the cartridge body applicable to any color, constituting the process cartridge.

As stated above, the illustrative embodiment also allows only one process cartridge 20 assigned to toner of a particular color to be mounted to each mount portion, obviating erroneous replacement and therefore enhancing the reliability of the printer.

Sixth Embodiment

Figure 10:
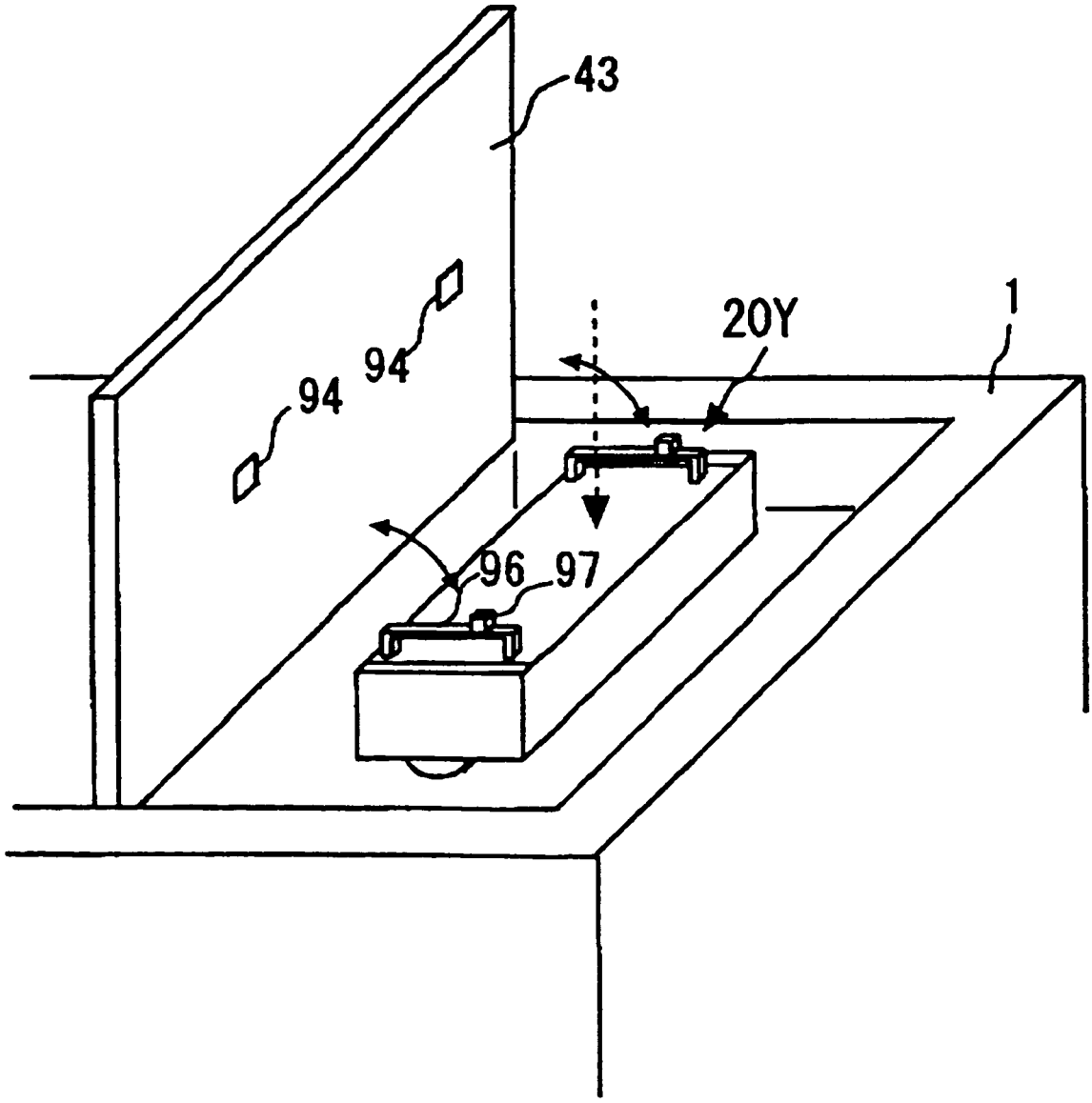
FIG. 10 is a perspective view showing a process cartridge representative of a sixth embodiment of the present invention together with an image forming apparatus.

FIG. 10 shows a sixth embodiment of the present invention. Briefly, this embodiment is essentially similar to the first embodiment except that the process cartridges are mounted to or dismounted from the printer in a different direction and in that each identification member is implemented as a handle.

FIG. 10 demonstrates how the process cartridge 20Y, for example, is mounted to the mount portion of the printer body 1. As shown, the process cartridge 20Y is provided with handles 96 configured to facilitate the transport and mounting of the process cartridge 20Y. The user is expected to open a door 43 hinged to the printer body 1 and then mount the process cartridge 20Y to a particular mount portion downward by holding the handles 96, as indicated by a dotted arrow in FIG. 10.

Further, projections 97 are formed on the handles 96 while holes 94 are formed in the door 43. The door 43 is fully closed only if its holes 94 successfully mate with the projections 97, allowing the process cartridge 20Y to be adequately mounted to the mount portion.

In the illustrative embodiment, the projections 97 of the handles 96 differ in position from toner of one color to toner of another color, although not shown specifically. Also, the holes 94 formed in the door 43 differ in position in matching relation to the projections 97. Stated another way, the handles or identification members 96 are positioned on the cartridge body applicable to any color, constituting the process cartridge.

As stated above, the illustrative embodiment also allows only one process cartridge 20 assigned to toner of a particular color to be mounted to each mount portion, obviating erroneous replacement and therefore enhancing the reliability of the printer.

In the embodiments shown and described, four process cartridges 20Y through 20BK to be mounted to one type of machine or image forming apparatus are dealt with, and each is made up of the cartridge body 20*a* applicable to toner of any color and an identification member particular to the cartridge body 20*a*. On the other hand, assume a plurality of different types of machines each using a particular kind of developer different in, e.g., toner grain size or composition from the others and assume that identical process cartridges are applicable to all of such machines. Then, each process cartridge may be made up of an identical cartridge body and a non-identical identification member. This is also successful to achieve advantages comparable with those of the illustrative embodiments.

The illustrative embodiments have been applied to the process cartridges 20. More specifically, each process cartridge 20 is made up of the identical cartridge body 20*a* non-identical identification member. However, the present invention is similarly applicable to any other device unit configured to store only a particular kind of developer. It is to be noted that a device unit refers to any unit capable of being replaceably mounted to the body of an image forming apparatus. For example, a device unit including only the developing device 23, i.e., a developing unit may be constituted by an identical unit body and a non-identical identification member. Likewise, a device unit including the developing unit 23 and at least one of the charger 22, cleaning device 25, image transferring members 24 and 30 and toner bottle 33 may be implemented by an identical unit body and a non-identical identification member.

Further, the numbers, positions, configurations and so forth of various members shown and described are only illustrative and may be varied, as desired.

In summary, a process cartridge or a device unit of the present invention is generally made up of an identical cartridge body applicable to any kind of developer and a non-identical identification member indicative of a particular kind of developer. Therefore, even when a plurality of process cartridges or device units different in the kind of developer from each other are removably mounted to an image forming apparatus, it is possible to free an operator from erroneous replacement and to reduce costs necessary for inventory control, production and delivery.

Various modifications will become possible for those skilled in the art after receiving the teachings of the present disclosure without departing from the scope thereof.

What is claimed is:

1. A process cartridge configured to be removably mounted to an apparatus body of an image forming apparatus, comprising:

a cartridge body;

an image carrier;

a developing device configured to develop a latent image formed on said image carrier, said developing device being configured to store a developer of any kind; and an identification member indicative of a kind of developer stored in said developing device, said identification member being removably fitted on said cartridge body, wherein said identification member comprises a plate member formed with a projection, a notch or a hole, and wherein a position of the projection, the notch or the hole on the plate member depends on the kind of the developer.

2. The process cartridge as claimed in claim 1, wherein said identification member is provided with a configuration dependent on the kind of the developer.

3. The process cartridge as claimed in claim 2, wherein said process cartridge is capable of being mounted to the apparatus body when the configuration of said identification member matches with a configuration of a mount portion included in said apparatus body.

4. The process cartridge as claimed in claim 1, wherein said identification member comprises a handle.

5. The process cartridge as claimed in claim 1, wherein said identification member comprises an engaging member engageable with a guide member configured to guide said process cartridge being mounted to or dismounted from said apparatus body.

6. The process cartridge as claimed in claim 1, wherein said identification member comprises a toner container storing a toner to be replenished to the developing device.

7. The process cartridge as claimed in claim 1, wherein said identification member comprises a protection member configured to selectively cover or uncover an exposed part of the image carrier.

8. The process cartridge as claimed in claim 1, wherein said identification member stores information dependent on the kind of the developer.

9. The process cartridge as claimed in claim 8, wherein the information comprises visible information using at least one of a mark, a letter and a color.

10. The process cartridge as claimed in claim 8, wherein the information comprises information capable of being electrically recognized.

11. The process cartridge as claimed in claim 8, wherein the information comprises information capable of being optically recognized.

12. The process cartridge as claimed in claim 8, wherein said identification member comprises a nonvolatile memory.

13. The process cartridge as claimed in claim 12, wherein the nonvolatile memory allows additional information to be stored therein.

14. The process cartridge as claimed in claim 13, wherein said process cartridge is operable on a mount portion if the information of said identification member is identical with information compared at a mount portion included in the apparatus body.

15. The process cartridge as claimed in claim 14, wherein the information comprises visible information using at least one of a mark, a letter and a color.

16. The process cartridge as claimed in claim 14, wherein the information comprises information capable of being electrically recognized.

17. The process cartridge as claimed in claim 14, wherein the information comprises information capable of being optically recognized.

18. The process cartridge as claimed in claim 1, wherein a regulating member is provided for regulating an operation of said process cartridge in the apparatus body, and said identification member is fitted on said cartridge body after said regulating member has been canceled.

19. The process cartridge as claimed in claim 18, wherein a cleaning blade is provided for cleaning the image carrier, and said regulating member regulates a pressure with which said cleaning blade contacts said image carrier.

20. The process cartridge as claimed in claim 18, wherein a charge roller is provided for charging the image carrier, and said regulating member regulates a distance at which said charge roller faces said image carrier.

21. The process cartridge as claimed in claim 18, wherein the developing device comprises a developing roller configured to feed toner to the image carrier, and said regulating member regulates a distance at which said developing roller faces said image carrier.

22. The process cartridge as claimed in claim 18, wherein the developing device comprises a seal member configured to prevent the developer from flowing out of said developing device, and said regulating member comprises said seal member.

23. The process cartridge as claimed in claim 1, further comprising a charger configured to charge the image carrier.

24. The process cartridge as claimed in claim 1, wherein the kind of the developer comprises a kind of a color of a toner.

25. The process cartridge as claimed in claim 1, further comprising a cleaning device configured to clean said image carrier.

26. A packed kit of a process cartridge configured to be removably mounted to an apparatus body of an image forming apparatus, comprising:

said process cartridge, including a cartridge body, an image carrier, and a developing device configured to develop a latent image formed on said image carrier, said developing device being configured to store a developer of any kind; and a plurality of identification members, each indicative of a different kind of developer stored in said developing device, said plurality of identification members being configured to be fitted on said cartridge body, wherein each identification member comprises a plate member formed with a projection, a notch or a hole, and wherein a position of the projection, the notch or the hole on the plate member depends on the kind of the developer.

27. An image forming apparatus, comprising:

an apparatus body; and a process cartridge removably mounted to said apparatus body, said process cartridge including:

a cartridge body, an image carrier, a developing device configured to develop a latent image formed on said image carrier, said developing device being configured to store a developer of any kind, and an identification member indicative of a kind of developer stored in said developing device, said identification member being removably fitted on said cartridge body, wherein said identification member comprises a plate member formed with a projection, a notch or a hole, and wherein a position of the projection, the notch or the hole on the plate member depends on the kind of the developer.

28. The apparatus as claimed in claim 27, wherein at least one mount portion is provided for mounting said process cartridge corresponding to the kind of the developer, and only said process cartridge provided with said identification member engageable with said mount portion is capable of being mounted to said mount portion.

29. The apparatus as claimed in claim 27, wherein at least one mount portion is provided for mounting said process cartridge corresponding to the kind of the developer, said mount portion comprises a comparing section for comparing information stored in said identification member, and only said process cartridge provided with said identification member determined to be proper by comparison is allowed to operate on said mount portion.

30. A device unit configured to be removably mounted on an apparatus body of an image forming apparatus, comprising:

a device unit body;

a developing device configured to develop a latent image formed on an image carrier, said developing device being configured to store a developer of any kind; and an identification member removably fitted to said device unit body and indicative of a kind of developer stored in said developing device, wherein said identification member comprises a plate member formed with a projection, a notch or a hole, and wherein a position of the projection, the notch or the hole on the plate member depends on the kind of the developer.

31. The device unit as claimed in claim 30, wherein said identification member is provided with a configuration dependent on the kind of the developer.

32. The device unit as claimed in claim 31, wherein said device unit is capable of being mounted to the apparatus body when the configuration of said identification member matches with a configuration of a mount portion included in said apparatus body.

33. The device unit as claimed in claim 30, wherein said identification member comprises a handle.

34. The device unit as claimed in claim 30, wherein said identification member comprises an engaging member engageable with a guide member configured to guide said device unit being mounted to or dismounted from said apparatus body.

35. The device unit as claimed in claim 30, wherein said identification member comprises a toner container storing a toner to be replenished to the developing device.

36. The device unit as claimed in claim 30, wherein said identification member stores information dependent on the kind of the developer.

37. The device unit as claimed in claim 36, wherein said device unit is operable on a mount portion if the information of said identification member is identical with information compared at a mount portion included in the apparatus body.

38. The device unit as claimed in claim 36, wherein the information comprises visible information using at least one of a mark, a letter and a color.

39. The device unit as claimed in claim 36, wherein the information comprises information capable of being electrically recognized.

40. The device unit as claimed in claim 39, wherein a regulating member is provided for regulating an operation of said device unit in the apparatus body, and said identification member is fitted on said device unit after said regulating member has been canceled.

41. The device unit as claimed in claim 40, wherein the developing device comprises a seal member configured to prevent the developer from flowing out of said developing device, and said regulating member comprises said seal member.

42. The device unit as claimed in claim 36, wherein the information comprises information capable of being optically recognized.

43. The device unit as claimed in claim 42, wherein a regulating member is provided for regulating an operation of said device unit in the apparatus body, and said identification member is fitted on said device unit after said regulating member has been canceled.

44. The device unit as claimed in claim 43, wherein the developing device comprises a seal member configured to prevent the developer from flowing out of said developing device, and said regulating member comprises said seal member.

45. The device unit as claimed in claim 36, wherein said identification member comprises a nonvolatile memory.

46. The device unit as claimed in claim 45, wherein the nonvolatile memory allows additional information to be stored therein.

47. The device unit as claimed in claim 45, wherein a regulating member is provided for regulating an operation of said device unit in the apparatus body, and said identification member is fitted on said device unit after said regulating member has been canceled.

48. The device unit as claimed in claim 47, wherein the developing device comprises a seal member configured to prevent the developer from flowing out of said developing device, and said regulating member comprises said seal member.

49. The device unit as claimed in claim 30, further comprising a charger configured to charge the image carrier.

50. The device unit as claimed in claim 30, wherein the kind of the developer comprises a kind of a color of the toner.

51. The device unit as claimed in claim 30, further comprising a toner container configured to store a toner.

52. A packed kit of a device unit removably mounted on an apparatus body of an image forming apparatus, comprising:

said device unit, including:

a device unit body, and a developing device configured to develop a latent image formed on an image carrier, said developing device being configured to store a developer of any kind; and a plurality of identification members configured to be fitted to said device unit body and each indicative of a different kind of developer stored in said developing device, wherein each identification member comprises a plate member formed with a projection, a notch or a hole, wherein a position of the projection, the notch or the hole on the plate member depends on the kind of the developer, and wherein said device unit body and said plurality of identification members are packed up together in said packed kit.

53. An image forming apparatus, comprising:

a device unit removably mounted on an apparatus body of said image forming apparatus, said device unit including:

a device unit body, a developing device configured to develop a latent image formed on an image carrier, said developing device being configured to store a developer of any kind, and an identification member removably fitted to said device unit body and indicative of a kind of developer stored in said developing device, wherein said identification member comprises a plate member formed with a projection, a notch or a hole, and wherein a position of the projection, the notch or the hole on the plate member depends on the kind of the developer.

54. The apparatus as claimed in claim 53, wherein at least one mount portion is provided for mounting said device unit corresponding to the kind of the developer, and only said device unit provided with said identification member engageable with said mount portion is capable of being mounted to said mount portion.

55. The apparatus as claimed in claim 53, wherein at least one mount portion is provided for mounting said device unit corresponding to the kind of the developer, said mount portion comprises a comparing section for comparing information stored in said identification member, and only said device unit provided with said identification member determined to be proper by comparison is allowed to operate on said mount portion.

56. A process cartridge configured to be removably mounted to an apparatus body of an image forming apparatus, comprising:

a cartridge body;

an image carrier;

a developing device configured to develop a latent image formed on said image carrier, said developing device being configured to store a developer of any kind; and an identification member indicative of a kind of developer stored in said developing device, said identification member being removably fitted on said cartridge body, wherein said cartridge body includes a front end and a rear end, wherein said identification member comprises a plate member with a first face including a projection and a second face opposite said first face, and wherein said identification member is fitted on a front end of said cartridge body such that said second face directly faces said front end of said cartridge body.

57. The process cartridge as claimed in claim 56, wherein said projection extends substantially parallel to an axis of rotation of said image carrier.

58. The process cartridge as claimed in claim 56, wherein a location of said projection on said first face indicates a color of developer stored in said developing device.

59. The process cartridge as claimed in claim 58, wherein said location of said projection is configured to correspond in position to a hole in a door of said image forming apparatus.

60. A process cartridge configured to be removably mounted to an apparatus body of an image forming apparatus, comprising:

a cartridge body;

an image carrier;

a developing device configured to develop a latent image formed on said image carrier, said developing device being configured to store a developer of any kind; and an identification member indicative of a kind of developer stored in said developing device, said identification member being removably fitted on said cartridge body, wherein said cartridge body includes two engaging members extending from a front end to a rear end on opposite sides of said cartridge body, and two retaining portions formed at a front end of said engaging members, wherein said identification member is held to said cartridge body by said two retaining portions.

61. The process cartridge as claimed in claim 60, wherein said two retaining portions are configured to mate with any of a plurality of mount rails of any one of a plurality of mount portions of said image forming apparatus.

62. An image forming apparatus, comprising:

an apparatus body;

a process cartridge removably mounted to said apparatus body, said process cartridge including:

a cartridge body, an image carrier, a developing device configured to develop a latent image formed on said image carrier, said developing device being configured to store a developer of any kind, and an identification member indicative of a kind of developer stored in said developing device, said identification member being removably fitted on said cartridge body; and a door hinged to said apparatus body, wherein said door includes a mating portion corresponding in position to said identification member.

63. A device unit configured to be removably mounted on an apparatus body of an image forming apparatus, comprising:

a device unit body;

a developing device configured to develop a latent image formed on an image carrier, said developing device being configured to store a developer of any kind;

an identification member removably fitted to said device unit body and indicative of a kind of developer stored in said developing device; and an image transferring device configured to transfer a toner image from said image carrier to a recording medium.

64. A device unit configured to be removably mounted on an apparatus body of an image forming apparatus, comprising:

a device unit body;

a developing device configured to develop a latent image formed on an image carrier, said developing device being configured to store a developer of any kind; and an identification member removably fitted to said device unit body and indicative of a kind of developer stored in said developing device, wherein said device unit is configured to mate with a pair of mount rails of any one of a plurality of mount portions of said image forming apparatus, and wherein said identification member is configured to mate with only one of a plurality of mounting portions of a door hinged to said apparatus body of said image forming apparatus.

65. The device unit as claimed in claim 64, wherein the plurality of mount portions of the door hinged to said apparatus body of said image forming apparatus are holes.

66. An image forming apparatus, comprising:

an apparatus body; and a plurality of process cartridges removably mounted to said apparatus body, said plurality of process cartridges each including:

a cartridge body, an image carrier provided on said cartridge body, a developing device provided on said cartridge body and configured to develop a latent image formed on said image carrier, said developing device being configured to store a developer of any kind, and an identification member indicative of a kind of developer stored in said developing device, said identification member being fitted on said cartridge body, wherein said identification member comprises a plate member formed with a projection, a notch or a hole, and wherein a position of the projection, the notch or the hole on the plate member depends on the kind of the developer, wherein said cartridge bodies of said plurality of process cartridges are identical to each other, and wherein said positions of said projections, said notches or said holes on the plate members of said identification members of said plurality of process cartridges are different from each other.

* * * * *